US006634427B1

(12) United States Patent
Turner et al.

(10) Patent No.: US 6,634,427 B1
(45) Date of Patent: Oct. 21, 2003

(54) DRILL STRING SECTION WITH INTERNAL PASSAGE

(75) Inventors: William E. Turner, Durham, CT (US); Ronald E. Seppa, Marlborough, CT (US)

(73) Assignee: APS Technology, Inc., Cromwell, CT (US)

( * ) Notice: Subject to any disclaimer, the term of this patent is extended or adjusted under 35 U.S.C. 154(b) by 0 days.

(21) Appl. No.: 10/095,174

(22) Filed: Mar. 11, 2002

(51) Int. Cl.[7] ..... E21B 17/18

(52) U.S. Cl. ..... 166/298; 166/380; 166/88.4; 166/242.3; 166/242.5; 76/108.4

(58) Field of Search ..... 166/244.1, 297, 166/298, 380, 85.1, 88.4, 241.5, 242.3, 242.5; 76/108.4

(56) References Cited

U.S. PATENT DOCUMENTS 3,291,225 A * 12/1966 Foran
4,876,780 A * 10/1989 Stahl et al.
5,931,000 A * 8/1999 Turner et al.
6,158,532 A 12/2000 Logan et al. ..... 175/320
6,176,323 B1 1/2001 Weirich et al. ..... 175/40
6,272,434 B1 8/2001 Wisler et al. ..... 702/9
6,308,137 B1 10/2001 Underhill et al. ..... 702/9
6,313,755 B1 11/2001 Hetmaniak et al. ..... 340/856.3

* cited by examiner

*Primary Examiner*—Roger Schoeppel
(74) *Attorney, Agent, or Firm*—Woodcock Washburn LLP

(57) ABSTRACT

Drill string sections are provided comprising internal passages that may be used to facilitate the electrical or hydraulic connection of multiple devices, such as sensors, arranged at spaced apart positions along the length of the drill sections. Methods of manufacturing the drill string sections are also provided, wherein the internal passages are formed by a first passage, a second passage, and a connecting passage therebetween.

41 Claims, 3 Drawing Sheets

DRILL STRING SECTION WITH INTERNAL PASSAGE

FIELD OF THE INVENTION

This invention relates to drill string sections comprising internal passages that facilitate the electrical or hydraulic connection of multiple devices, such as sensors, arranged at spaced apart positions along the length of the drill sections. This invention also relates to methods of manufacturing drill sections comprising internal passages.

BACKGROUND OF THE INVENTION

Drilling assemblies for boring holes deep into the earth are well known. For example, drilling assemblies are used by the oil and gas industry for retrieving various fluids and gases buried within earth formations. Typical drilling assemblies comprise a drilling string including a plurality of interconnected sections with a drill bit on the end thereof. Rotating the interconnected sections may rotate the drill bit. Alternatively, the interconnected sections are held static and the drill bit rotated by employing internally disposed mechanisms that are driven by drilling fluid commonly referred to as "mud," which is supplied under pressure from a surface source into the drill string. The drilling fluid discharges at the drill bit and returns to the surface through the annular space between the drill string and the wellbore wall. Fluid returning to the surface may carry cuttings produced by the drill bit, as well as, conditions of the formation being cut and the condition of the drill bit itself.

Down hole measuring and communication systems frequently referred to as measurement-while-drilling ("MWD") and logging-while drilling ("LWD") are typically disposed within drill string sections above and in close proximity to the drill bit. The systems comprise sensors for collecting down hole parameters, such as parameters concerning the drilling assembly itself, the drilling fluid, and those of formations surrounding the drilling assembly. For example, sensors may be employed to measure the location and orientation of the drill bit, and to detect buried utilities and other objections, critical information in the underground utility construction industry. Sensors may be provided to determine the density, viscosity, flow rate, pressure and temperature of the drilling fluid. Other sensors are used to determine the electrical, mechanical, acoustic and nuclear properties of the subsurface formations being drilled. Chemical detection sensors may be employed for detecting the presence of gas. These measuring and communication systems may further comprise power supplies and microprocessors that are capable of manipulating raw data measured by the various sensors. Information collected by sensors may be stored for later retrieval, transmitted to the earth's surface via telemetry while drilling, or both. Transmitted information provides the bases for adjusting the drilling fluid properties and/or drilling operation variables, such as drill bit speed and direction.

A drill string section including an MWD and/or LWD system will generally have several sensors positioned at spaced apart locations along the length of the drill string, a microprocessor, and a power supply, all being electrically connected by wires. In other applications, such as, for example, pressure sensors, it is desirable to connect spaced apart locations (along a drill collar) hydraulically by fluid passages.

Normally passages are drilled from the ends of the drill string section to house the electrical wires, and thereafter sealed in some manner, such as by welding. The ends of drill string sections usually comprise a coupling means, commonly a threaded portion, such that a plurality of drill sting sections can be directly interconnected without employing additional hardware. Unfortunately, the presence of the passages within a threaded end region creates stress risers that may lead to structural failure of the drill string section. Passages within the threaded ends also create problems for threading re-work, which is beneficial for extending the life of a drill string section.

One solution to the above-identified problems that has been used in the past is to drill passages from one end of a first drill pipe and towards its opposing end, seal the passage opening, and then weld a second drill pipe that does not contain any passages to the sealed end of the first drill pipe. A threaded connection can then be formed on the exposed ends of the connected drill pipes, thereby maintaining the passage internally and distal to the threaded connections.

This drill string section manufacturing technique, however, has limitations. The first drill pipe comprising the wire passage will generally have relatively thicker walls (that is, a relatively smaller bore) to accommodate the wire passage, whereas the second drill pipe will have relatively thinner walls (that is, a larger relative bore) to minimize weight and manufacturing cost while maximizing flow rates of drilling fluid. In such a stepped bore arrangement the weld joint is necessarily located, at least partially, in a thin-walled area (interface of the connected first and second drill pipes). This can compromise the structurally integrity of the resulting drill string section, and limit the maximum strain the drill string section can tolerate before failure.

Another limitation of this manufacturing technique is the length of the drill string section and number of sensors accomodatable therewith. It is preferred to have drill string sections as long as possible to improve drilling efficiency, and to employ several sensors and corresponding electrical devices. Since the wire passage is only formed in the first section of drill pipe, the overall length of the drill string section will be limited to that of current methods of small diameter and long hole drilling.

Accordingly, a need still exists for improved methods of manufacturing drill string sections that comprise lengthy internal wire passages, and that overcome problems such as those described above.

SUMMARY OF THE INVENTION

The present invention provides an improved method of manufacturing a drill string section comprising an internal passage. In accordance with a preferred embodiment of the present invention, there has now been provided a method of manufacturing a drill string section including an internal passage extending along a substantial portion of its length, the method comprising the steps of: providing a drill string section comprising a first end, an opposing second end, an outer surface, and a centrally disposed bore extending from the first end to the second end so as to form a wall between the bore and the outer surface; separating the drill string section into first and second portions, the first portion comprising the first end and a third end formed by said separation, the second portion comprising the second end and a fourth end formed by said separation; forming a first blind and generally axially extending passage through the wall from the third end towards the first end and to a position spaced apart from the first end; forming a second blind and generally axially extending passage through the wall from the fourth end towards the second end and to position spaced apart from the second end; joining the third end of the first portion to the fourth end of the second portion so as to form a unitary section of drill string in which the first and second passages are misaligned; and forming a connecting passage from the outer surface of the drill string section that intersects the first and second passages, whereby the connected first and second passages define the drill sting section internal passage.

In accordance with another embodiment of the present invention, there has now been provided a method of manufacturing a drill string section including an internal passage extending along a substantial portion of its length, the method comprising the steps of: providing first and second drill pipes, each pipe comprising a first end, an opposing second end, a pipe wall, and a passage extending generally axially through the pipe wall from the first end to a position spaced apart from the second end; joining the first and second drill pipes at their respective first ends so that the passages are misaligned and so as to form the drill string section; and forming a connecting passage from an outer surface of the drill string section that intersects the two passages, whereby the connected two passages define the drill string section internal passage.

The present invention also provides a drill string section including an internal passage extending along a substantial portion of its length. Drill string section embodiments provided by the present invention can be made by methods such as those described above and provided by the present invention, but are not limited thereto. In accordance with a preferred embodiment, there has now been provided a drill string section comprising a first end; a second end; a wall; an intermediate weld joint; a first blind and generally axially extending passage extending through the wall from the weld joint toward the first end; a second blind and generally axially extending passage extending through the wall from the weld joint toward the second end, the second passage being misaligned with the first passage; and a connecting passage extending through the weld joint intersecting the first and second passages, the connecting passage oriented at an acute angle with respect to a drill string section centerline; wherein the first passage, the second passage and a portion of the connecting passage define the drill string section internal passage.

These and various other features of novelty, and their respective advantages, are pointed out with particularity in the claims annexed hereto and forming a part hereof. However, for a better understanding of aspects of the invention, reference should be made to the drawings which form a further part hereof, and to the accompanying descriptive matter, in which there is illustrated preferred embodiments.

DETAILED DESCRIPTION OF THE PREFERRED EMBODIMENTS

Figure 1A:
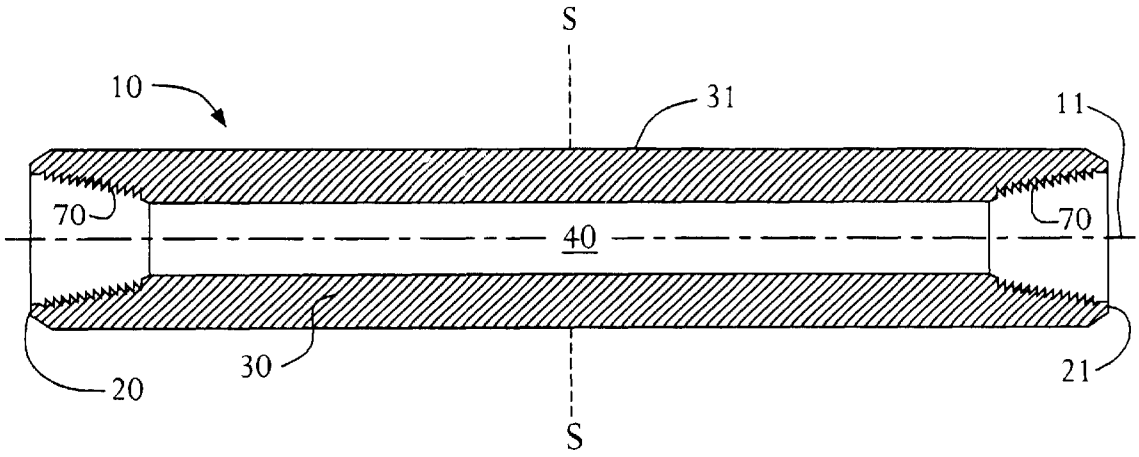
FIG. 1*a* is a cross-sectional view of a drill string section of the present invention before any operations are performed upon it.

The present invention is directed to improved drill string sections comprising internal passages, useful for accommodating electrical wiring or hydraulic fluid, as well as, methods of manufacturing improved drill string sections. Referring now to the drawings, wherein like reference numerals designate corresponding structure throughout the views, and referring in particular to FIGS. 1*a*–1*e* illustrating steps of a first preferred manufacturing method. Referring to FIG. 1*a*, a drill string section 10 in the form of a drill pipe is provided having a first end 20, a second 21, a pipe wall 30, an outer surface 31, an internal bore 40, and an axial centerline 11. Drill sting section 10 is separated along a line S into a first portion 50 and a second portion 51. Although the separation point is shown as substantially equally spaced from first and second ends 20, 21, the drill string section can be separated at any position intermediate first and second ends 20, 21. "Intermediate" herein means any position between two reference points and is not limited to the middle position.

Figure 1B:
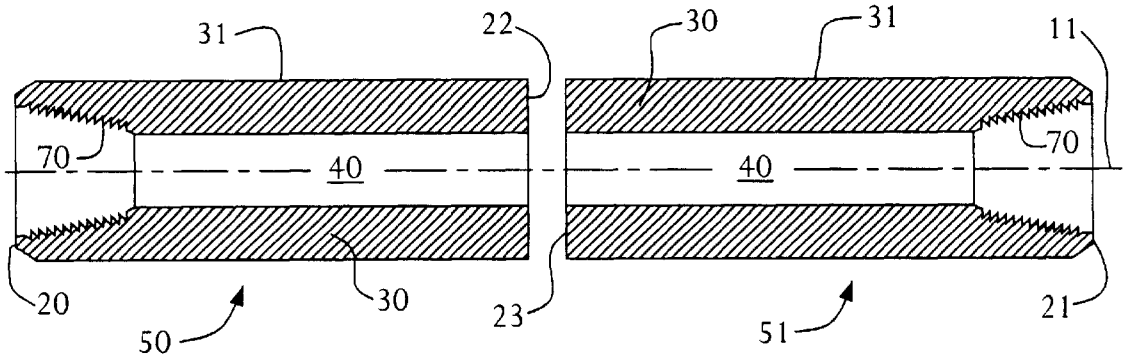
FIG. 1*b* is a cross-sectional view of first and second portions of the drill string section shown in FIG. 1 a after the drill string section is severed.
Figure 1C:
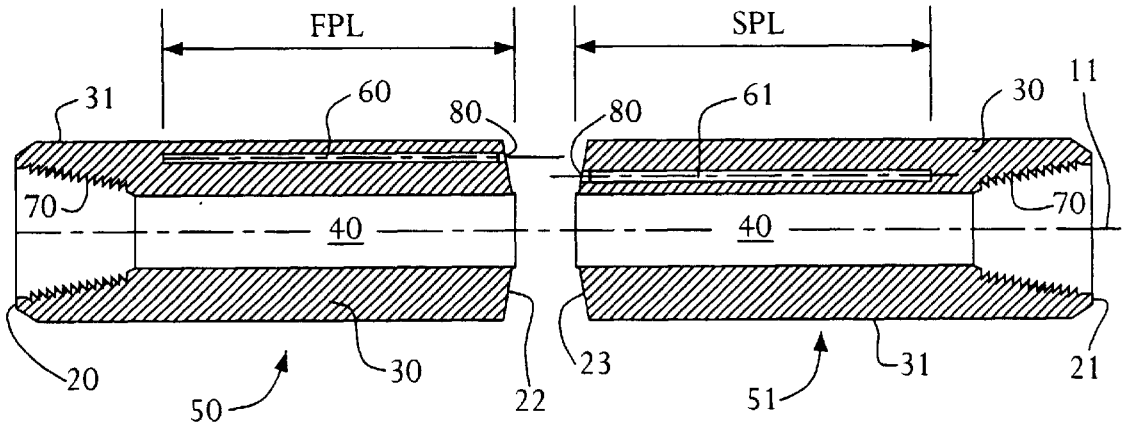
FIG. 1*c* is a cross-sectional view of the first and second portions shown in FIG. 1*b* with the first and second portions including internally formed first and second passages.

Referring to FIG. 1*b*, first portion 50 includes first end 20 and an end 22 formed by the separation step. Referring to FIG. 1*c*, a first generally axially extending passage 60 is formed in pipe wall 30, preferably by drilling, from end 22 to a position spaced apart from first end 20 (that is, passage 60 is a blind passage). Since first passage 60 does not extend to or through threading 70, stress risers can be substantially reduced. First passage 60 being spaced apart from threading 70 will also permit reworking of the threads, which can extend the life of a drill string section and ensure a good seal with complimentary interconnected drill string sections.

Second portion 51 includes second end 21 and an end 23 formed by the separation step. In a similar fashion to that described above, a second generally axially extending passage 61 is formed in pipe wall 30 from end 23 to a position spaced apart from second end 21 (that is, passage 61 is a blind passage). First and second passages 60, 61 have respective lengths FPL and SPL. Preferably, one of FPL and SPL is at least about 30 inches long, and more preferably at least about 95 inches long.

Figure 1D:
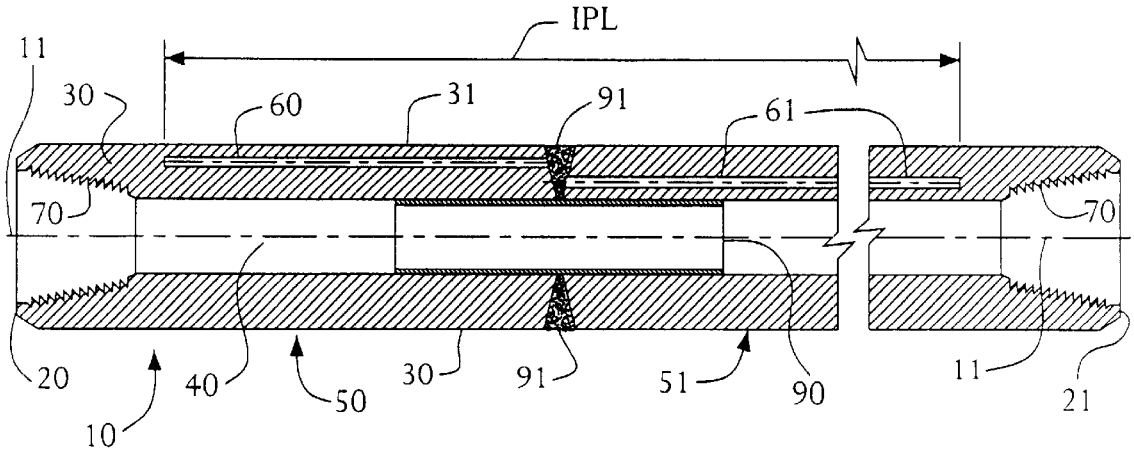
FIG. 1*d* is a cross-sectional view of the first and second portions shown in FIG. 1*c* being joined together.

Referring now to FIG. 1*d*, first and second portions 50, 51 are joined, preferably through welding end 22 to end 23 so as to form a unitary section of drill string. Entrances to first and second passages 60, 61 are blocked, for example, by inserting pins 80 (shown in FIG. 1*c*), such that joining material (for example, solder) does not extend into the passages. In addition, ends 22 and 23 may be manipulated prior to joining the first and second portions for improving the integrity of the resulting joint. For example, and as can be seen in FIG. 1*c*, ends 22 and 23 may be beveled in preparation for welding the first and second portions together. To facilitate joining the first and second portions of the drill string section, an alignment sleeve 90 may optionally be employed to maintain the relative positions of the first and second portions during the joining step.

Figure 1E:
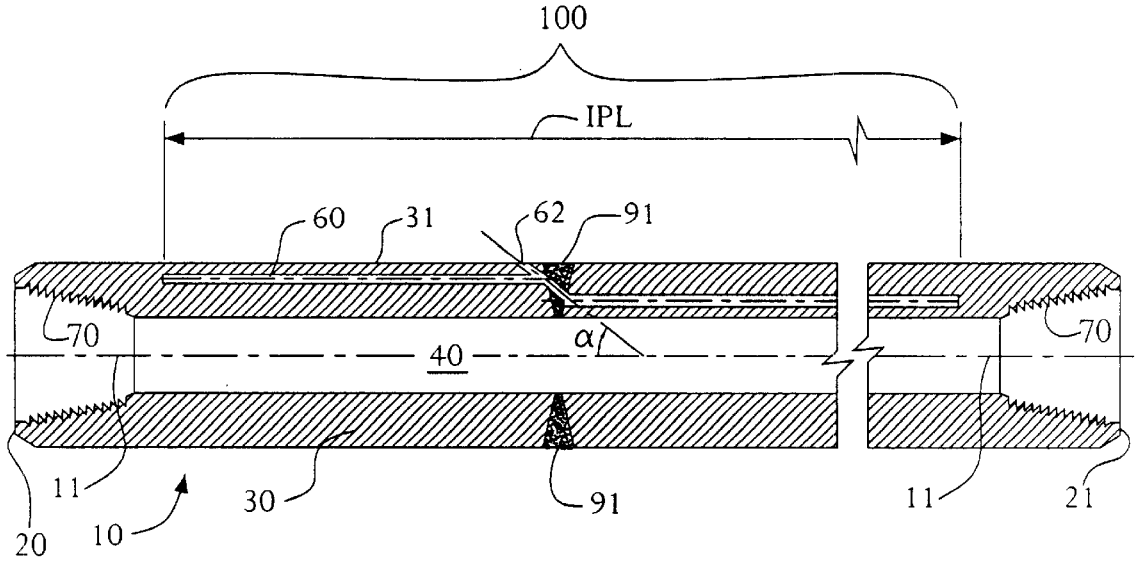
FIG. 1*e* is a cross-sectional view of the drill string section shown in FIG. 1*d* including a connecting passage that interests the first and second internal passages.
Figure 2:
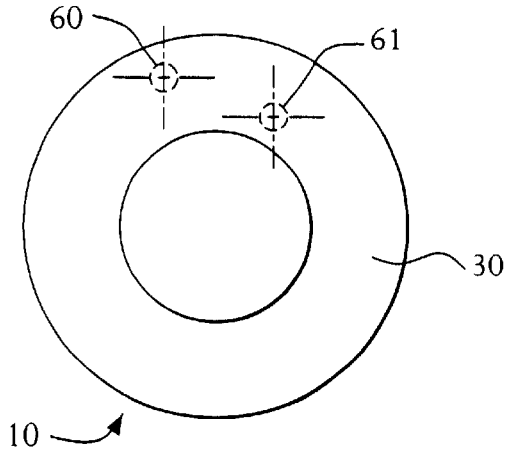
FIG. 2 is an end view of a drill section of the present invention depicting first and second internal passages that are both radially and circumferentially misaligned.

In one preferred embodiment, first passage 60 and second passage 61 are misaligned when the first and second portions 50, 51 are joined. As can be seen in FIGS. 1*d* and 1*e*, the first and second passages may be radially offset or misaligned. Alternatively, the passages may be circumferentially misaligned, or as shown in FIG. 2, may be both radially and circumferentially misaligned.

As can been seen in FIG. 1*e*, a connecting passage 62 is now formed from outer surface 31, through joint 91 (illustrated as a weld joint in FIG. 1*e*), intersecting first and second passages 60 and 61, respectively. Connecting passage 62 is preferably drilled at an acute angle $\alpha$ with respect to centerline 11. Angle $\alpha$ is typically in the range from about 20 to about 70 degrees. In preferred embodiments, the entrance of connecting passage 62 is blocked, such as, by example, with a pin 80. First passage 60, second passage 61, and a portion of connecting passage 62 thus define an internal passage 100. In a preferred embodiment, internal passage 100 has a length IPL of at least about 125 inches long.

The location of the first and second passages must be determined prior to forming connecting passage 62. This location-determining step may include application of ultrasonic equipment. Alternatively, a reference line can be scribed on the drill string section at the separation point, such that segments of the scribed line will span first and second portions once the drill sting section is separated. The first and second passages can then be formed using this reference line, and the separated portions rejoined by lining up the scribed line segments.

Internal passage 100 may provide a number of advantages, one of which is the accommodation of electrical wiring to connect multiple electrical devices disposed along the length of drill string section 10. Logging-while-drilling (LWD) or measurement-while-drilling (MWD) involves the recording and/or transmission to the earth's surface, of down hole measurements taken during drilling boreholes or wellbores. These systems are generally accommodated by one or more drill string sections located proximate a connected drill bit. LWD and MWD systems may comprise one or more of the following electrical devices: sensors, data microprocessors, and power supplies. Sensors are useful for obtaining information regarding the formation being drilled, and the operating condition of the drill bit and the drilling fluid. Based upon the down hole measurements, corrective actions may be taken at the surface, such as, for example, altering the drilling fluid composition, altering the drilling fluid pump rate, or shutting down the drilling operation.

Figure 3:
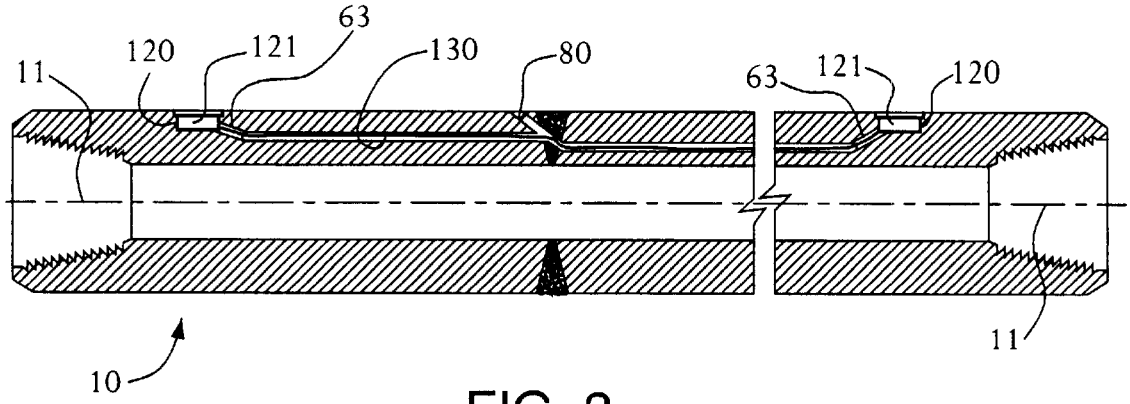
FIG. 3 is a cross-sectional view of a drill section of the present invention including a plurality of pockets formed in the drill section outer wall and a plurality of electrical devices seated therein.

Referring now to FIG. 3, drill string section 10 comprises a plurality of seats 120 that extend from the outer surface 31 to one of the first passage 50 and the second passage 51. Seats 120 may be formed by methods known to persons having ordinary skill in the art, such as drilling or milling. Linking passages 63 are cross-drilled from seats 120 to internal passage 100. At least one electrical device 121 is disposed within each of seats 120. Two or more electrical devices 121 maybe electrically connected by wiring 130 extending through internal passage 100, through linking passages 63, and to the electrical devices 121. In alternative embodiments provided by the present invention, linking passages 63 are eliminated by the internal passage 100 directly intersecting a portion of seats 120. By way of example, a MWD system may comprise a sensor for monitoring the drilling fluid pressure, a sensor for monitoring the drilling fluid temperature, another for detecting the presence of gas (for example, methane), and another for monitoring the orientation of the drill bit. Each of the above exemplary sensors could be disposed in an individual seat 120, and electrically connected to a power supply and a microprocessor disposed in other individual seats 120, via electrical wiring 130 extending through internal passage 100.

Figure 4:
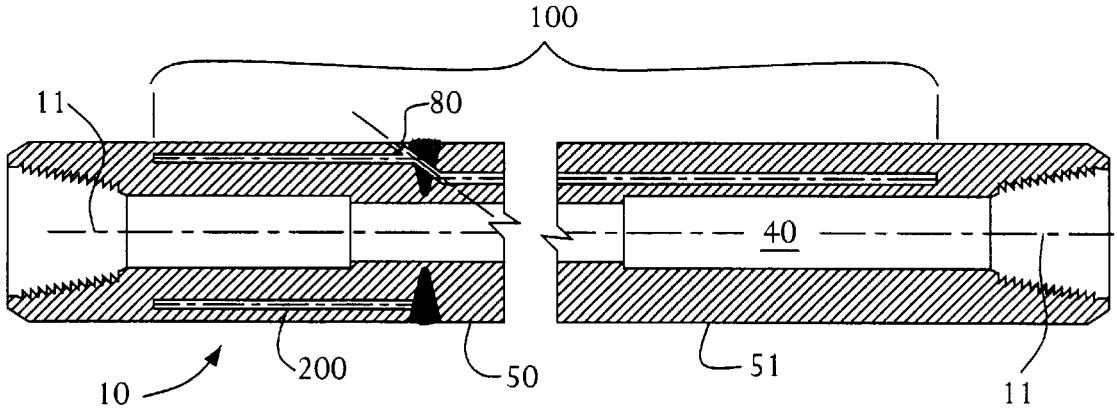
FIG. 4 is a cross-sectional view of a drill string section of the present invention including multiple internal passages, as well as, a stepped bore configuration.

Drill string section 10 may comprise multiple internally formed passages. The internal passages may be defined by multiple connected passages that are formed in adjacent portions of the drill string as described above, or may be defined by a single passage formed in only one portion of the drill string section. For example, and as is illustrated in FIG. 4, drill string section 10 includes a first internal passage 100, formed by connecting passages formed in both first and second portions 50, 51, and a second internal passage 200 defined by a passage formed only in first portion 50.

Drill string sections of the present invention may comprise a single diameter bore, such as those shown in FIGS. 1 and 2, or alternatively include bores having different diameters. In a stepped bore configuration, as is shown in FIG. 4, the present invention provides an advantage of positioning the weld joint (for rejoining separated portions of the drill string section) in the portion of the drill string section having the greatest wall thickness (smallest bore), thereby improving the section's structural integrity.

In an alternative preferred embodiment, a drill string section comprising an internal passage is manufactured by joining two or more separately made drill pipes together, with each of the drill pipes including passages extending from one end towards an opposing second end. This alternative embodiment may follow similar steps as those illustrated in FIGS. 1*b*–1*e* (eliminating the step of beginning with a single drill string section and then separating the section into two portions as shown in FIG. 1*a*), with first and second portions 50 and 51 representing first and second independently manufactured drill pipes.

Drill string sections of the present invention may be made from any material known by those having skill in the art, such as, for example, steel. Lengths of the drill string sections vary according to their application, with one example being approximately 170 inches long. Outer and inner diameters vary as well; an example outer diameter is 7 inches and an example inner diameter (bore size) is 3 inches. Internal passages, as discussed above, may be used to accommodate electrical wiring or hydraulic fluid. In this capacity, exemplary internal passage diameters range from about ¼inch to about 1 inch. Internal passage diameters will obviously change according to additional applications beyond that of accommodating electrical wiring. The preceding dimensions should not be construed as limiting, as one having ordinary skill in the art would readily appreciate numerous changes that determinable, without undue experimentation, depending on the application of the invention provided herein.

It is to be understood that even though numerous characteristics and advantages of the present invention have been set forth in the foregoing description, together with details of the structure, manufacture of, and function of the invention, the disclosure is illustrative only. Accordingly, changes may be made in detail, especially in matters of shape, size and arrangement of structural features, as well as, sequences of manufacturing steps, within the principles of the invention to the full extent indicated by the broad general meaning of the terms in which the appended claims are expressed.

What is claimed is:

1. A method of manufacturing a drill string section including an internal passage extending along a substantial portion of its length, the method comprising the steps of:

(a) providing a drill string section comprising a first end, an opposing second end, an outer surface, and a centrally disposed bore extending from the first end to the second end so as to form a wall between the bore and the outer surface;

(b) separating the drill string section into first and second portions, the first portion comprising the first end and a third end formed by said separation, the second portion comprising the second end and a fourth end formed by said separation;

(c) forming a first blind and generally axially extending passage through the wall from the third end towards the first end and to a position spaced apart from the first end;

(d) forming a second blind and generally axially extending passage through the wall from the fourth end towards the second end and to position spaced apart from the second end;

(e) joining the third end of the first portion to the fourth end of the second portion so as to form a unitary section of drill string in which the first and second passages are misaligned; and (f) forming a connecting passage from the outer surface of the drill string section that intersects the first and second passages, whereby the connected first and second passages define the drill string section internal passage.

2. The method of claim 1, wherein the first and second portions are joined by welding.

3. The method of claim 2, wherein the connecting passage extends through a formed weld joint.

4. The method of claim 1, wherein the connecting passage is oriented at an acute angle with respect to a drill string section centerline.

5. The method of claim 1, wherein the first and second passages are radially misaligned after the joining step (e).

6. The method of claim 1, wherein the first and second passages are circumferentially misaligned after the joining step (e).

7. The method of claim 1, further comprising a step, before step (e), of blocking entrances of the first and second passages.

8. The method of claim 7, wherein the blocking step includes inserting pins into the first and second passages.

9. The method of claim 1, further comprising a step, before step (f), of determining the location of the first and second passages.

10. The method of claim 1, further comprising a step of scribing a reference line on the drill string section for forming the first and second passages.

11. The method of claim 1, wherein at least one of the first and second passages is at least about 30 inches long.

12. The method of claim 1, wherein at least one of the first and second passages is at least about 95 inches long.

13. The method of claim 1, wherein the first passage, second passage, and a portion of the connecting passage together form an internal passage that is at least about 125 inches long.

14. The method of claim 1, wherein the drill string section has a second internal passage formed therein.

15. The method of claim 1, further comprising a step, before step (e), of inserting an alignment sleeve into the first portion and the second portion to facilitate permanent joining as completed in step (e).

16. The method of claim 1, wherein the drill string section first and second ends each comprises a threaded region such that the drill string sections can be coupled to other drill string sections.

17. The method of claim 1, further comprising a step of forming a plurality of pockets in the drill string section, each pocket extending from the outer surface to one of the first passage and the second passage.

18. The method of claim 17, further comprising steps of disposing a plurality of electrical devices in the plurality of pockets and connecting the electrical devices with electrical wiring disposed within the first and second passages.

19. The method of claim 18, wherein the plurality of electrical devices are selected from the group consisting of sensors, microprocessors, and power supplies.

20. A method of manufacturing a drill string section including an internal passage extending along a substantial portion of its length, the method comprising the steps of:

(a) providing first and second drill pipes, each pipe comprising a first end, an opposing second end, a pipe wall, and a passage extending generally axially through the pipe wall from the first end to a position spaced apart from the second end;

(b) joining the first and second drill pipes at their respective first ends so that the passages are misaligned and so as to form the drill string section; and (c) forming a connecting passage from an outer surface of the drill string section that intersects the two passages, whereby the connected two passages define the drill string section internal passage.

21. The method of claim 20, wherein the two passages are radially misaligned ter the joining step (b).

22. The method of claim 20, wherein the two passages are circumferentially misaligned after the joining step (b).

23. The method of claim 20, wherein at least one of the two passages is at least about 30 inches long.

24. The method of claim 20, wherein at least one of the two passages is at least about 95 inches long.

25. The method of claim 20, wherein the two passages together form an internal passage that is at least about 125 inches long.

26. The method of claim 20, further comprising a step of forming a plurality of pockets in the drill string section, each pocket extending from the outer surface to one of the two passages.

27. The method of claim 26, further comprising the steps of disposing a plurality of electrical devices in the plurality of pockets and connecting the electrical devices with electrical wiring disposed within the two passages.

28. The method of claim 27, wherein the plurality of electrical devices are selected from the group consisting of sensors, microprocessors, and power supplies.

29. A drill string section including an internal passage extending along a substantial portion of its length, the drill string section comprising:

a first end;

a second end;

a wall;

an intermediate weld joint;

a first blind and generally axially extending passage extending through the wall from the weld joint toward the first end;

a second blind and generally axially extending passage extending through the wall from the weld joint toward the second end, the second passage being misaligned with the first passage; and a connecting passage extending through the weld joint intersecting the first and second passages, the connecting passage oriented at an acute angle with respect to a drill string section centerline;

wherein the first passage, second passage and a portion of the connecting passage define the drill string section internal passage.

30. The drill string section of claim 29, wherein the first and second passages are radially misaligned.

31. The drill string section of claim 29, wherein the first and second passages are circumferentially misaligned.

32. The drill string section of claim 29 further comprising a plurality of pockets, each pocket extending from the outer surface to at least one of the first passage and the second passage.

33. The drill string section of claim 32, further comprising a plurality of electrical devices disposed within the plurality of pockets.

34. The drill string section of claim 33, wherein at least some of the plurality of electrical devices are electrically connected with wiring disposed within the first and second passages.

35. The drill string section of claim 29, wherein at least one of the first and second passages is at least about 30 inches long.

36. The drill string section of claim 29, wherein at least one of the first and second passages is at least about 95 inches long.

37. The drill string section of claim 29, wherein the first and second passages together form an internal passage that is at least about 125 inches long.

38. The drill string section of claim 29, wherein the drill string section has a second internal passage formed therein.

39. The drill string section of claim 29 further comprising an internal bore, wherein the internal bore has a larger diameter at locations proximate at least one of the first end and the second end than at locations proximate the intermediate weld joint.

40. The drill string section of claim 29 made by a method according to claim 1.

41. The drill string section of claim 29 made by a method according to claim 18.

* * * * *